US006372706B1

(12) United States Patent
Boulos

(10) Patent No.: US 6,372,706 B1
(45) **Date of Patent: *Apr. 16, 2002**

(54) ALKALINE HARD SURFACE CLEANER AND PROCESS THEREWITH

(75) Inventor: Mervet S. Boulos, Troy, MI (US)

(73) Assignee: Henkel Corporation, Gulph Mills, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/725,782

(22) Filed: Oct. 4, 1996

(51) Int. Cl.[7] ..... C11D 17/00; C11D 17/08

(52) U.S. Cl. ..... 510/420; 510/423; 510/433

(58) Field of Search ..... 510/423, 420, 510/433

(56) References Cited

U.S. PATENT DOCUMENTS

| | | | | |
|---|---|---|---|---|
| 5,043,022 A | | 8/1991 | Koesters et al. | 134/3 |
| 5,464,553 A | * | 11/1995 | Winston et al. | 510/255 |
| 5,534,181 A | | 7/1996 | Henkel et al. | 510/423 |
| 5,635,465 A | * | 6/1997 | Sobata et al. | 510/274 |
| 5,663,132 A | | 9/1997 | Talley | 510/218 |

* cited by examiner

*Primary Examiner*—Mukund J. Shah
*Assistant Examiner*—Tamthom N. Truong
(74) *Attorney, Agent, or Firm*—Wayne C. Jaeschke; Stephen D. Harper; Lance G. Johnson

(57) ABSTRACT

Strong alkaline cleaning solutions and concentrates therefor can be prepared without using any phosphorus or nitrogen containing surfactants by combining a weak carboxylate surfactant with at least one, or preferably both, of an aliphatic alcohol alkoxylate nonionic surfactant and an alkyl phenol alkoxylate nonionic surfactant. The predominant alkoxylates in the nonionic surfactants are ethoxylates, but at least the non-aromatic based surfactant preferably contains some propoxylate also.

16 Claims, No Drawings

ALKALINE HARD SURFACE CLEANER AND PROCESS THEREWITH

BACKGROUND OF THE INVENTION

1. Field of the Invention

The invention relates to a process for cleaning hard surfaces, particularly those of metal objects, which are contaminated with oil or similar materials that are widely used as lubricants in machining and/or as temporary protection against corrosion. Such oily materials normally must be substantially totally removed from a metal surface in order to prepare it for uniform formation on the surface of a coating that will provide long term protection against corrosion.

The term "alkaline cleaning solutions" as used herein includes all aqueous solutions that contain (i) at least one dissolved alkalinizing constituent, such as alkali or alkaline earth metal hydroxides, carbonates, borates, phosphates, or silicates and (ii) either no off-setting acid or an amount of such acid that leaves the total composition with a pH greater than 8. The borates, phosphates, and silicates in this class include both simple and condensed types, such as metasilicate, pyrophosphate and tripolyphosphate, and borax and the like. The alkali and alkaline earth metals include particularly sodium, potassium, magnesium, calcium, barium, and the like. More particularly this invention relates to such cleaning solutions, and concentrates for making them, that contain hydroxide(s) as the sole or at least the most predominant alkalinizing constituent.

2. Statement of Related Art

Normally, alkaline cleaner compositions now used for metal surface preparation contain a surfactant component, which may be a single chemical type of surfactant or a mixture of such chemical types, including any or all of the classes of anionic, cationic, amphoteric ionic, and nonionic surfactants. (Cationic surfactants are less commonly used than the other types in metal cleaning formulations, because they are more likely to affect the subsequent processing and treatment of the metal surface in some manner that may be adverse.) Nonionic surfactants are generally preferred for cleaning power, but are not readily dissolved in highly concentrated aqueous solutions of hydroxide, which are desirable for economic reasons to minimize the cost of shipping water: If a highly concentrated liquid can be supplied as a strong alkaline cleaner concentrate, working cleaning solutions that contain the alkaline ingredients from the concentrate can be more economically prepared with local water supplies at the point of use.

It is known that the dissolution of nonionic surfactants into concentrated alkaline aqueous solutions can be aided by mixing with some types of anionic surfactants that contain phosphorous. However, there are often environmental objections to phosphorus containing cleaners. Surfactants containing amine groups, such as are used in some commercial product surfactant mixtures recommended for strongly alkaline cleaners, also can be environmentally undesirable.

DESCRIPTION OF THE INVENTION

OBJECTIONS OF THE INVENTION

One major objective of the invention is to provide an alkaline, if desired very strongly alkaline, aqueous cleaning composition and/or a surfactant combination therefor, with cleaning power at least as good as that achieved by conventional prior art compositions that utilize substantial amounts of phosphorus and/or nitrogen containing surfactants but with minimization of the amounts of phosphorus and/or nitrogen used in the compositions. Another concurrent or alternative objective is to provide alkaline aqueous cleaning compositions with better cleaning power than those of the prior art. Other objectives will appear from the description below.

GENERAL PRINCIPLES OF DESCRIPTION

Except in the claims and the operating examples, or where otherwise expressly indicated to the contrary, all numerical quantities in this description indicating amounts of material or conditions of reaction and/or use are to be understood as modified by the word "about" in describing the broadest scope of the invention. Practice within the numerical limits stated is generally preferred, however. Also, throughout the description and claims, unless expressly stated to the contrary: percent, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole, and any counterions thus implicitly specified preferably are selected from among other constituents explicitly specified in ionic form, to the extent possible; otherwise such counterions may be freely selected, except for avoiding counterions that act adversely to the objects of the invention; and the term "mole" and its variations may be applied to ionic, chemically unstable neutral, or any other chemical species, whether actual or hypothetical, that is specified by the type(s) of atoms present and the number of each type of atom included in the unit defined, as well as to substances with well defined neutral molecules.

SUMMARY OF THE INVENTION

It has been found that a mixture of particular types of nonionic surfactants with a particular type of anionic organic material, both substantially free from any chemical elements other than carbon, hydrogen, and oxygen, can achieve good cleaning power with acceptably low foaming in moderately to strongly alkaline aqueous cleaning compositions and has sufficient solubility to permit formulation of stable one package liquid concentrates with more than 25% of total alkali metal hydroxide content.

DETAILED DESCRIPTION OF THE INVENTION, INCLUDING PREFERRED EMBODIMENTS

One preferred embodiment of the invention is an aqueous liquid composition that is suitable, as such, after dilution with water, or both as such and after dilution with water, for cleaning hard surfaces, particularly steel and galvanized steel surfaces. This composition comprises, preferably consists essentially of, or more preferably consists of, water and:

(A) an amount of a dissolved alkalinizing component;

(B) an amount of a dissolved component of organic material selected from the group consisting of molecules that contain, in each molecule, (i) at least one carboxyl or carboxylate moiety and (ii) a total of at least 10 carbon atoms; and (C) an amount of a dissolved component of nonionic surfactants, exclusive of those that are part of any of the previously recited components, selected from molecules that each contain at least four —($CH_2CH_2O$)— moieties, preferably joined to one another in a block;

and, optionally, one of more of the following components:

(D) an amount of a component of sequestering agent and/or chelating agent that is not part of any of the previously recited components; and (E) an amount of a component of antifoam agent that is not part of any of the previously recited components.

Preferred alkalinizing agents for component (A) include ammonium, sodium, and potassium hydroxides, with the latter two more preferred. Both of these appear substantially equal in promoting cleaning. Sodium hydroxide is usually less expensive but also forms less soluble salts with almost any acidic material that might be added to the composition and/or is less tolerant of non-electrolytes in mutual aqueous solution with it, so that at least some potassium hydroxide is normally preferred for very strong concentrates according to the invention. In one specific preferred embodiment, only potassium and/or sodium hydroxide(s) are used for component (A).

Independently of other preferences, in a concentrate composition according to the invention, the amount of dissolved hydroxide in component (A) is such as to provide at least, with increasing preference in the order given, 1.0, 2.0, 3.0, 3.5, 3.8, 4.1, 4.4, 4.7, or 5.0 moles of $OH^-$ per kilogram of total concentrate composition. The total stoichiometric equivalent as hydroxide ions of all soluble alkali metal and alkaline earth metal hydroxides dissolved in the composition is to be considered as dissolved $OH^-$ for determining whether these preferential values are achieved, except when acids or other reagents known to be rapidly reactive with aqueous hydroxide ions are also added to the compositions; in such an instance, only the net remaining hydroxide ions after theoretically complete neutralization or other rapid reaction of such added reagents are considered to be dissolved $OH^-$. In a working composition according to the invention, the concentration of dissolved hydroxide ions preferably is from 0.5 to 3.0% of the concentrations stated earlier in this paragraph to be preferred for concentrate compositions.

Component (B) is preferably selected from molecules that contain, in each molecule, at least two moieties selected from the group consisting of (i) carboxyl and carboxylate moieties and (ii) carbonyl and hydroxyl moieties that are not part of carboxyl or carboxylate moieties, said two moieties independently preferably being separated from each other within said molecules by at least two atoms in said molecules that are not part of said moieties. More preferably, at least two moieties selected from the group consisting only of carboxyl and carboxylate moieties are present in each molecule of component (B), and independently, the carbon atoms in each of said moieties are separated by exactly two or exactly three other atoms in a molecule of component (B). For purposes of this description, a single moiety of the general formula:

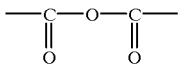

is considered to be equivalent to two carboxyl or carboxylate moieties, because it is expected to hydrolyze very rapidly to the corresponding dicarboxylic acid or salt thereof when added to a composition according to the invention. Independently of all other preferences, the molecules of component (B) preferably have numbers of total carbon atoms and of moieties selected from the group consisting of (i) carboxyl and carboxylate moieties and (ii) carbonyl and hydroxyl moieties that are not part of carboxyl or carboxylate moieties such that, in the average over all of component (B), the number of total carbon atoms has a ratio to the total number of moieties selected from the group consisting of (i) carboxyl and carboxylate moieties and (ii) carbonyl and hydroxyl moieties that are not part of carboxyl or carboxylate moieties that is at least, with increasing preference in the order given, 3.0:1.0, 3.5:1.0, 4.0:1.0, 4.5:1.0, 5.0:1.0, 5.5:1.0, or 5.9:1.0 and independently preferably is not more than, with increasing preference in the order given, 20:1.0, 18: 1.0, 16:1.0, 14:1.0, 12:1.0, 11.0:1.0, 10.0:1.0, 9.0:1.0, 8.0:1.0, 7.5:1.0, 7.0:1.0, or 6.5:1.0. Most preferably, component (B) is selected from octenyl- and nonenyl-succinic acids and their salts, which may be added to compositions either as such or as anhydrides as noted above.

Component (C) preferably includes molecules that conform to at least one of general formulas I and II:

(I)

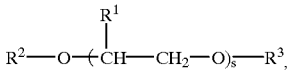

wherein $R^1$ represents a hydrogen atom or a methyl group and may be the same or different from one molecule to another within the component and from one location to another within a single molecule of the component; $R^2$ represents a linear, cyclic, and/or branched, saturated or unsaturated, monovalent aliphatic moiety that (1) either (1.1) is a hydrocarbon moiety or (1.2) may be formally derived from a hydrocarbon moiety by (1.2.1) substitution of at least one halogen atom for at least one hydrogen atom and/or (1.2.2) substitution of at least one ether oxygen atom for at least one methylene group that is separated by at least three carbon atoms from the oxygen atom shown in formula (I) that is bonded directly to $R^2$ and (2) has a total number of carbon atoms and ether oxygen atoms such that the average value for the total number of carbon atoms and ether oxygen atoms in each of the $R^2$ moieties in the total of all of the molecules in the aqueous liquid composition that conform to general formula I is at least, with increasing preference in the order given, 5.0, 6.0, 7.0, 8.0, 9.0, 10.0, 11.0, or 11.8 and independently preferably is not more than, with increasing preference in the order given, 50, 40, 30, 25, 20, 18,16, 15.0, 14.0; 13.5, 13.0, or 12.5; $R^3$ represents a hydrogen atom or a monovalent organic moiety with not more than three total carbon atoms; and s represents a positive integer, but need not represent the same positive integer for each molecule; and:

(II)

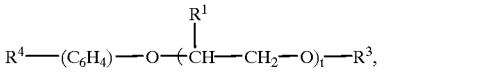

wherein $R^1$ and $R^3$ have the same meaning as for general formula I; $R^4$ represents a linear, cyclic, and/or branched, saturated or unsaturated, monovalent aliphatic moiety that (1) either (1.1) is a hydrocarbon moiety or (1.2) may be formally derived from a hydrocarbon moiety by (1.2.1) substitution of at least one halogen atom for at least one hydrogen atom, (1.2.2) substitution of at least one ether oxygen atom for at least one methylene group, or (1.2.3) both substitution of at least one halogen atom for at least one hydrogen atom and substitution of at least one ether oxygen atom for at least one methylene group and (2) has a total number of carbon atoms and ether oxygen atoms such that the average value, over all of the molecules in the composition that conform to general formula II, for the total number of carbon atoms and ether oxygen atoms in each of the $R^4$ moieties in the composition is at least, with increasing preference in the order given, 3.0, 4.0, 5.0, 6.0, 7.0, 7.5, or 8.0 and independently preferably is not more than, with increasing preference in the order given, 20, 18, 16, 15.0, 14.0, 13.0, 12.0, 11.0, 10.0, or 9.0; $(C_6H_4)$ represents an ortho-, meta-, or para-phenylene nucleus; and t represents a positive integer, but need not represent the same positive integer for each molecule.

The molecules of component (C) that conform to general formula I as given above may be designated collectively hereinafter as component (C.1), and analogously the molecules of component (C) that conform to general formula II as given above may be designated collectively hereinafter as component (C.2). Either or both of components (C.1) and (C.2) may, but need not necessarily, constitute all of component (C).

More preferably, independently for each preference given, independently in each of components (C.1) and (C.2) for which the specified moiety occurs in the corresponding general formula: each of $R^2$ and $R^4$ is linear or has only one methyl side chain on an otherwise linear structure; $R^3$ is selected from the group consisting of hydrogen, methyl, ethyl, propyl, formyl, and acetyl moieties; average values, over all of said component, for s and for the fraction of $R^1$ for which $R^1$ represents a hydrogen atom are such that the hydrophile-lipophile balance (hereinafter usually abbreviated as "HLB") value[1] for component (C.1) is at least, with increasing preference in the order given, 5.0, 5.5, 6.0, 6.5, 7.0, 7.5, 7.9, or 8.2 and independently preferably is not more than, with increasing preference in the order given, 20.0, 19.0, 18.0, 17.0, 16.0, 15.0, 14.7, 14.4, 14.1, 13.9, or 13.7; and average values, over all of component (C.2), for t and for the fraction of $R^1$ for which $R^1$ represents a hydrogen atom, are such that the HLB value for component (C.2) is at least, with increasing preference in the order given, 8.0, 9.0, 10.0, 11.0, 11.5, 12.0, 12.3, 12.6, 12.9, 13.2, or 13.5 and independently preferably is not more than, with increasing

[1]If the HLB value for a particular commercial nonionic surfactant or mixture of surfactants is given as a range by its supplier and the chemical formula of the surfactant is not known, the arithmetic mean of the ends of the range is considered to be the single HLB value for the material for the purposes of the definition of this invention. If the chemical formula of a nonionic surfactant is known, the HLB value for the purposes of the definition of this invention is to be calculated by the methods described in D. Meyer, *Surfactant Science and Technology* {VCH Publishers, New York and Weinheim, 1988}, formulas 6–10 and 6–11 and Table 6.2 on pages 236–237. preference in the order given, 20, 18.0, 17.0, 16.5, 16.0, 15.5, 15.0, 14.5, 14.1, 13.9, or 13.8.

Still more preferably, primarily for reasons of economy and independently for each of $R^2$ and $R^4$: the average number, over all of component (C.2) for $R^4$ or of component (C.1) for $R^2$, of ether oxygen atoms per $R^2$ or $R^4$ moiety is not more than, with increasing preference in the order given, 2.0, 1.5, 1.0, 0.5, 0.3, 0.1, 0.02, or 0.002; and, independently, the average number, over all of component (C.2) for $R^4$ or of component (C.1) for $R^2$, of halogen atoms per $R^2$ or $R^4$ moiety is not more than, with increasing preference in the order given, 10, 8, 6, 4, 2.0, 1.5, 1.0, 0.5, 0.3, 0.1, 0.02, or 0.002.

Independently of all other stated preferences, for component (C.1), on an average over the total component, each molecule contains at least one $R^1$ moiety that is methyl rather than hydrogen.

Preferably, a working cleaning composition according to the invention contains components (B), (C), (C.1), and (C.2) as described above in concentrations such that, independently for each preference stated: the concentration of component (C.1) is at least, with increasing preference in the order given, 0.001, 0.002, 0.004, 0.006, 0.008, or 0.010% but, primarily for reasons of economy, is not greater than, with increasing preference in the order given, 10, 5, 4.0, 3.0, 2.0, 1.0, 0.80, 0.70, 0.60, 0.50, 0.40, 0.30, 0.20, 0.10, 0.080, 0.060, 0.040, or 0.020%; the concentration of component (C.2) is at least, with increasing preference in the order given, 0.002, 0.004, 0.008, 0.012, 0.016, or 0.020% but independently, primarily for reasons of economy, is not greater than, with increasing preference in the order given, 10, 5, 4.0, 3.0, 2.0, 1.0, 0.80, 0.70, 0.60, 0.50, 0.40, 0.30, 0.20, 0.10, 0.080, 0.060, 0.040, or 0.030%; the ratio of the concentration of component (C.2) to the concentration, if this concentration is not zero, of component (C.1) is at least, with increasing preference in the order given, 0.10:1.0, 0.20:1.0, 0.30:1.0, 0.35:1.0, 0.40:1.0, 0.45:1.0, or 0.50:1.0 but independently is not more than, with increasing preference in the order given, 50:1.0, 40:1.0, 30:1.0, 20:1.0, 10:1.0, 9.0:1.0, 8.0:1.0, 7.0:1.0, 6.0:1.0, 5.0:1.0, 4.0:1.0, 3.0:1.0, 2.5:1.0, or 2.0:1.0; the concentration of component (B) is at least, with increasing preference in the order given, 0.20, 0.30, 0.40, 0.50, 0.60, 0.70, 0.80, 0.90, or 0.98 times the larger of (i) 4.0 times the concentration of component (C.1) and (ii) 0.50 times the concentration of component (C.2) but independently, primarily for reasons of economy, is not more than, with increasing preference in the order given, 20, 15, 12, 10, 8, 7.0, 6.5, 6.0, 5.5, 5.0, or 4.5 times greater than the concentration of total component (C).

The major reason observed for a preference for the presence of both components (C.1) and (C.2) is that the latter is more effective in cleaning and more soluble in strongly alkaline aqueous solutions but has a strong tendency to foam, whereas the former contributes some cleaning power on its own and also unexpectedly acts as an exceptionally effective defoamer for an aqueous composition otherwise including only components (A), (B), and (C.2).

Resistance to foaming is usually practically important in use of any cleaning composition, because the generation of excessive amounts of foam can make most cleaning process lines ineffective. A laboratory test that has been found generally well correlated with practical foaming resistance is performed as follows:

A volume of 100 milliliters of composition to be tested is placed in a glass stoppered graduated cylinder with at least 250 ml capacity. The cylinder and its contents are brought to temperature equilibrium by any convenient method, usually a controlled temperature bath, and then are vigorously shaken up and down by hand, while upright with the stopper in place, twenty times in quick succession. Immediately after this shaking is completed, the cylinder is placed upright on a horizontal table and the stopper is removed. A timer is started immediately after the stopper has been removed. The foam volume is determined from the graduations on the cylinder by noting the difference between the graduations at the top of the foam and at the top of the underlying liquid composition in the cylinder at a time 30±1 and/or 60±1 seconds after the timer was started.

A working composition according to the invention, or a solution in water containing 2.0% of a concentrate composition according to the invention, preferably has a foam volume when measured by the above test that is not greater than, with increasing preference in the order given, 150, 100, 75, 60, 50, 40, 30, 25, 20, 15, 12, 10, 8, 7.0, 6.0, 5.0, 4.0, 3.0, or 2.0 milliliters.

Component (B) has relatively little cleaning power but appears to act as an unexpectedly effective hydrotrope for solubilizing component (C) into strongly alkaline aqueous solutions.

Suitable sequestering agents for optional component (D) include sorbitol, mannitol, gluconates, citrates, heptogluconates, ethylene diamine tetraacetic acid ("EDTA"), nitrilotriacetic acid ("NTA"), and other water soluble organic compounds containing at least two carboxyl, carboxylate, and/or hydroxyl moieties, the last being exclusive of hydroxyl moieties that are part of carboxyl moieties, that are separated from one another within the molecule by at least two, more preferably by exactly two or three, other atoms that are not part of the carboxyl, carboxylate, or hydroxyl moieties, along with the salts, particularly the potassium and sodium salts, of all of the compounds previously recited in this paragraph that are acids. Gluconates, heptogluconates, EDTA, NTA, sorbitol, and/or mannitol are preferred. The concentration of sequestering agents in a concentrate composition according to the invention preferably is at least, with increasing preference in the order given, 0.1, 0.3, 0.5, 1.0, 1.5, 2.0, 2.5, 2.9, 3.1, or 3.3% and independently, primarily for reasons of economy, is not more than, with increasing preference in the order given, 20, 15, 10, 8.0, 7.0, 6.0, 5.0, 4.5, 4.1, 3.9, or 3.7%.

Cleaning according to the invention may be performed by any method which brings soiled hard surfaces to be cleaned into contact with a liquid working cleaning composition according to the invention for a sufficient time to transfer at least part of the soil on the hard surface into the liquid working cleaning composition, then removing the surface to be cleaned from contact with the liquid working cleaning composition, and, optionally but usually, rinsing the cleaned surface with water to remove any adherent cleaning composition. Preferably, during contact between a surface to be cleaned and a composition according to the invention, the temperature of the composition according to the invention is at least, with increasing preference in the order given, 30, 35, 40, 45, 50, 55, or 60° C. and independently, primarily for reasons of economy, preferably is not more than, with increasing preference in the order given, 90, 85, 80, 75, 70, or 65° C. Spraying the surfaces to be cleaned with a working cleaning composition is generally preferred to other methods of contacting these surfaces, because the mechanical action of spray impingement aids in rapid transfer of soils into the liquid cleaner.

Preferably, to avoid environmental pollution and for other varied reasons, compositions according to the invention preferably contain, independently for each preferably minimized component stated below, not more than, with increasing preference in the order given, 5.0, 3.0, 1.0, 0.5, 0.2, 0.10, 0.05, 0.02, 0.01, 0.005, 0.002, 0.001, 0.0005, 0.0002, 0.0001, 0.00005, 0.00002, or 0.00001 percent of any of: phosphorus, nitrogen, and any material that (i) is not part of one of the necessary or optional components stated above and (ii) is regulated under U.S. law as a "Volatile Organic Compound".

Further appreciation of the present invention may be had from the following examples and comparison examples which are intended to illustrate, but not limit, the invention.

EXAMPLES AND COMPARISON EXAMPLES

The liquid compositions shown in Tables 1 and 2 below, most but not all of which are according to the invention, were prepared, and working compositions from some of them were prepared and used, as described in the notes to the tables. All of these compositions, except #10, were optically clear and showed no visual evidence of phase separation.

TABLE 1

| Ingredient | Percent of Ingredient in Composition Number: 1 | 2 | 3 | 4 | 5 | 6 |
|---|---|---|---|---|---|---|
| 50% Sodium Hydroxide in Water | 9.6 | 9.6 | 9.6 | 9.6 | 9.6 | 9.6 |
| 45% Potassium Hydroxide in Water | 24.0 | 24.0 | 24.0 | 24.0 | 24.0 | 24.0 |
| Sodium Gluconate (powder) | 3.5 | 3.5 | 3.5 | 3.5 | 3.5 | 3.5 |
| Nonenyl Succinic Anhydride | 1.0 | 2.0 | 3.0 | 3.0 | 2.0 | 2.0 |
| TRITON ™ X-405 | 1.0 | 1.0 | — | — | — | 1.0 |
| TRITON ™ X-100 | — | — | — | 0.5 | 0.5 | 0.5 |
| TERGITOL ™ 15-S-3 | — | — | 3.0 | 2.5 | 1.5 | — |

Notes for Table 1

The balance not explicitly shown for each composition in the Table was water.

TRITON ™ X-405 was supplied commercially by Van Waters and Rogers and was reported by its supplier to be a modified polyethoxy adduct of an alcohol, resulting in a nonionic surfactant with an HLB value of 13.6;

TRITON ™ X-100 was supplied commercially by Van Waters and Rogers and was reported by its supplier to be a polyethoxy adduct of nonyl phenol, resulting in a nonionic surfactant with an HLB value of 13.5; and TERGITOL ™ 15-S-3 was supplied commercially by Van Waters and Rogers and was reported by its supplier to be a modified polyethoxy adduct of $C_{11-15}$ secondary alcohols, resulting in a nonionic surfactant with an HLB value of 8.3.

TABLE 2

| Ingredient | Percent of Ingredient in Composition Number: 7 | 8 | 9 | 10 | 11 | 12 | 13 | 14 |
|---|---|---|---|---|---|---|---|---|
| 50% Sodium Hydroxide in Water | — | — | — | — | — | — | 5.0 | — |
| 45% Potassium Hydroxide in Water | 40.0 | 40.0 | 40.0 | 50.0 | 40.0 | 40.0 | 65.0 | 70.0 |
| Nonenyl Succinic Anhydride | 20.0 | 12.0 | 12.0 | 12.0 | 12.0 | 2.0 | 2.0 | 2.0 |
| TRITON ™ X-100 | — | — | 1.0 | 1.0 | 12.0 | 4.0 | 1.0 | 1.0 |
| ANTAROX ™ LF-224 | — | 3.0 | 3.0 | 3.0 | — | — | 0.50 | 0.50 |

TABLE 2-continued

| Ingredient | Percent of Ingredient in Composition Number: | | | | | | | |
|---|---|---|---|---|---|---|---|---|
| | 7 | 8 | 9 | 10 | 11 | 12 | 13 | 14 |
| Foam Volume, Milliliters, After: | | | | | | | | |
| 30 Seconds | 5 | 2 | 7 | n.m. | 230 | 130 | 30 | 2 |
| 60 Seconds | 1 | 2 | 6 | n.m. | 230 | 130 | 30 | 2 |
| % Water-Break Free | 0 | 70 | 100 | n.m. | 100 | 100 | 100 | 100 |

Notes for Table 2
The balance not explicitly shown for each composition in the Table was water.
Foam volume values were measured on 2.0% solutions of the concentrates in water at 49° C. by the test method described in the main text.
"n.m." means "not measured" (because the composition was not a single phase).
% Water-Break values were measured by visual estimation by an experienced rater, as the area percent of the surfaces of standardized soiled metal test panels that were not covered with water breaks, i.e., separation of an adherent water layer into visually obvious thick and thin areas, after thorough water rinsing following immersion, without additional mechanical agitation, for 10 minutes in a working composition that was made by dissolving the corresponding concentrate in water to provide a 2.0% solution of the concentrate in the working composition and was maintained at 60° C. during the immersion.

The invention claimed is:

1. A stable, aqueous, alkaline cleaning concentrate composition containing less than 0.002% of nitrogen and:

(a) an alkali metal hydroxide alkalinizing agent in an amount of at least 1 moles of hydroxide per kilogram of total concentrate composition;

(b) an anionic surfactant containing: at least 10 carbon atoms; and at least one carboxylate or carboxyl moiety per molecule wherein the ratio of total carbon atoms in said anionic surfactant to carboxyl and carboxylate moieties is at least 4;

(c) a nonionic surfactant containing at least four—$(CH_2CH_2O)$—moieties;

(d) a sequestering agent or a chelating agent; and (e) an antifoam agent.

2. A cleaning composition according to claim 1 wherein said alkalinizing agent comprises ammonium, sodium hydroxide or potassium hydroxide.

3. A cleaning composition according to claim 1 wherein said anionic surfactant contains at least one carboxylate or carboxylate moiety per molecule.

4. A cleaning composition according to claim 2 wherein said anionic surfactant also contains carbonyl or hydroxyl moieties that are not part of said carboxylate or carboxyl moiety.

5. A cleaning composition according to claim 1 wherein said anionic surfactant is selected from the group consisting of octenyl-succinic acids, nonenyl-succinic acids, and salts thereof.

6. A cleaning composition according to claim 1 wherein said nonionic surfactant has the structure of general formula I or II:

(I)

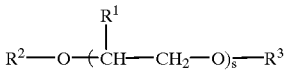

(II)

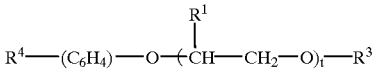

wherein:

$R^1$ is independently represents hydrogen or methyl;

$R^2$ is a saturated or unsaturated, monovalent aliphatic moiety;

$R^3$ is hydrogen or a monovalent moiety of no more than three carbon atoms and containing only atoms selected from the group consisting of carbon, hydrogen and oxygen;

$R^4$ is an aliphatic hydrocarbon, a halogen substituted hydrocarbon, an ether substituted hydrocarbon;

s is an integer of at least 4 and whose value is chosen to produce an HLB value within the range of 5–20; and t is an integer of at least 4 and whose value is chosen to produce an HLB value within the range of 8–20.

7. A cleaning composition according to claim 6 wherein:

$R^2$ and $R^4$ are independently selected from linear aliphatic hydrocarbons or aliphatic hydrocarbons with only one methyl side chain on an otherwise linear structure; and $R^3$ is selected from hydrogen, methyl, ethyl, propel, formyl, and acetyl moieties.

8. A cleaning composition according to claim 1 wherein said composition contains 0.002–10% of said nonionic surfactant.

9. A cleaning composition according to claim 1 wherein said composition contains nonionic surfactants of both formula I and formula II.

10. A cleaning composition according to claim 1 wherein said anionic surfactant is in an amount sufficient to act as a hydrotope for solubilizing said nonionic surfactant.

11. A cleaning composition according to claim 1 wherein said sequestering agent is sorbitol, mannitol, a gluconate, a citrate, a heptogluconate, ethylene diamine tetraacetic acid, or nitrilotriacetic acid.

12. A cleaning composition according to claim 1 wherein said alkalinizing agent is an alkali metal hydroxide, said sequestering agent is sodium gluconate, said anionic surfactant is nonenyl-succinic anhydride, and said nonionic surfactant is a polyether adduct of nonyl phenol.

13. A cleaning composition according to claim 1 wherein said alkali metal hydroxide is in an amount of at least 5 moles of hydroxide per kilogram of total concentrate.

14. A cleaning composition according to claim 1 wherein said alkali metal hydroxide is in an amount within the range of 18–31.5 wt % of said concentrate composition.

15. A cleaning composition consisting essentially of the ingredients of claim 1.

16. A cleaning composition according to claim 1 wherein said anionic surfactant and said nonionic surfactant are each substantially free of any chemical element other than carbon, hydrogen, or oxygen.

* * * * *

UNITED STATES PATENT AND TRADEMARK OFFICE

CERTIFICATE OF CORRECTION

PATENT NO. : 6,372,706 B1
DATED : April 16, 2002
INVENTOR(S) : Boulos

It is certified that error appears in the above-identified patent and that said Letters Patent is hereby corrected as shown below:

Column 10,
Line 45, delete “hydrotope”, and insert therefor -- hydrotrope --.

Signed and Sealed this

Tenth Day of February, 2004

JON W. DUDAS
*Acting Director of the United States Patent and Trademark Office*